United States Patent [19]

Jensen et al.

[11] 4,104,927

[45] Aug. 8, 1978

[54] ENGINE STARTER

[76] Inventors: Jørn Benned Jensen, 6990 Ulfborg; Jens Herman Jensen, Hørsholm Kongevej 1, 2970 Hørsholm, both of Denmark

[21] Appl. No.: 745,731

[22] Filed: Nov. 29, 1976

[51] Int. Cl.[2] ..... F02N 5/02

[52] U.S. Cl. ..... 123/179 S; 185/41 A; 185/43

[58] Field of Search ..... 74/6; 123/179 S; 185/41 A, 43

[56] References Cited

U.S. PATENT DOCUMENTS

| | | | |
|---|---|---|---|
| 1,252,626 | 1/1918 | Stewart | 185/41 A |
| 1,280,241 | 10/1918 | Kolourek | 185/41 A |
| 3,763,842 | 10/1973 | Dooley et al. | 123/179 S |

*Primary Examiner*—Allan D. Herrmann

*Attorney, Agent, or Firm*—Beveridge, De Grandi, Kline & Lunsford

[57] ABSTRACT

An engine starter with a rotatable drum, a spring, and a planetary gear. An axially extending clutch bushing is permanently connected to one end of the motor shaft. The clutch bushing is via a clutch connectable to the sun gear, the clutch not engaging until the bushing exceeds a predetermined number of revolutions. Thus the spring of the engine starter is not retensioned for a new start until the engine has come well into operation. When the torque of the engine starter has reached a predetermined level the clutch disengages so that the spring is not broken.

8 Claims, 5 Drawing Figures

ENGINE STARTER

Figure 1:
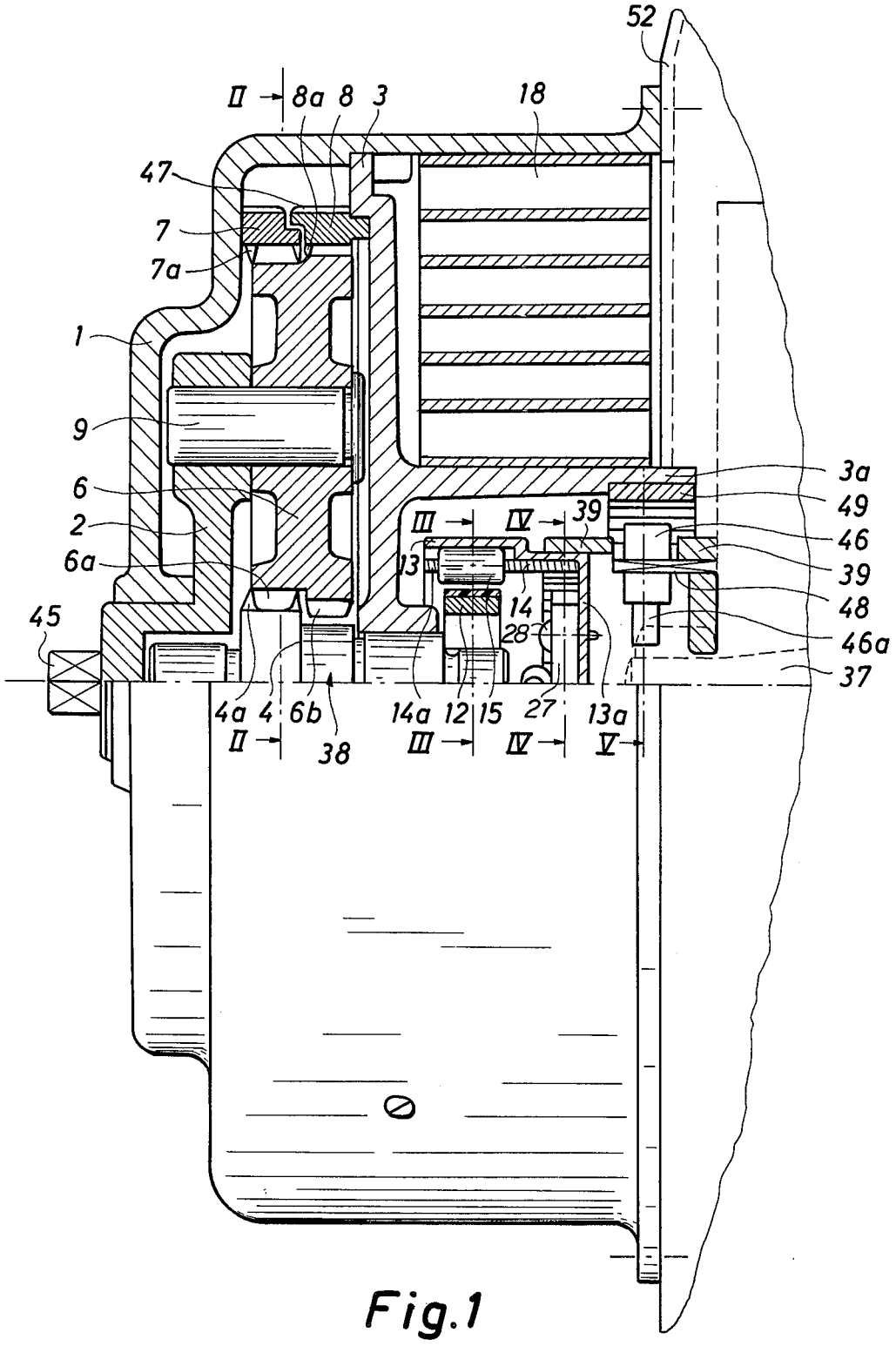

The invention relates to an engine starter of the type comprising at least one spring releasably connected at one end to the motor shaft via a rotatable drum and at the other end secured to the inside of a stationary housing of the starter, and a planetary gear driving the drum.

French patent specification No. 1,316,958 discloses a starter comprising a shaft surrounded by a drum, and a spiral spring being secured at the inner end to the hub of the drum and at the outer end to an adjustable portion. When the spring is tensioned, and the engine is to be started, a particular brake shoe connected to a lever is raised from a planet wheel carrier of a planetary gear. Now the drum is free and starts to rotate influenced by the tensioned spring. A pawl protruding from the hub into the shaft transmits the rotary motion of the drum to the shaft. During this rotary motion the planetary gear and the drum rotate as a fixed unit. When the engine has started, the pawl slips the shaft whereby the engine drives the starter. During this operation the planet wheel carrier is secured in such manner that the drum is reversely rotated, i.e. opposite the shaft. This starter has, however, the disadvantage that the engine has not come quite into operation before it is to tension the spring of the starter. When the spring is sufficiently tensioned, the outer end of said spring influences a lever thus locking the shaft and the portion carrying the outer end of the spring, relative to each other by means of a brake assembly. Since the spring is tensioned, the spring, the drum, and the planetary gear rotate in the same direction as the shaft. When the engine does not start at the first attempt, the spring must be retensioned by hand, i.e. by turning manually the sun gear of the planetary gear. In addition to the above immediate load of the engine at the tensioning of the spring, the starter has the disadvantage of being very complicated and consequently very expensive to manufacture.

The object of the invention is to provide an engine starter of the above type permitting the engine to come well into operation before the spring is to be tensioned, and furthermore being very simply constructed.

The engine starter according to the invention is characterized in that the starter comprises an axially extending clutch bushing permanently connected to one end of the motor shaft, said clutch bushing being connectable to a sun gear or to a separate shaft section on said sun gear via a clutch, said clutch engaging when the bushing exceeds a predetermined value of the number of revolutions when said number increases, and disengaging when a predetermined torque has been exceeded, and that two outer rings internally toothed surround the planet wheels, each planet wheel comprising two toothings, and each of the above rings meshing with its respective planet wheel toothing, and that the first ring is connected to the housing and the other ring is secured to the drum. As a result the started engine does not drive the starter until the number of revolutions has exceeded a predetermined value, in other words the engine does not recharge the starter with energy until the engine has come well into operation. Consequently, the risk of an unsuccessful attempt to start is very small. Since the above clutch disengages when a predetermined torque has been exceeded, it is ensured that the spring is not tensioned so much via the planetary gear that it breaks. When the above torque has been reached the planetary gear disengages, thus implying that the drum and a further tensioning of the spring stop, and now the starter is ready for a new start. As it appears no large masses in the starting engine rotate together with the motor shaft long after the starting. When the engine is stopped and is to be restarted, the drum is disengaged, and the energy stored in the spring is transmitted to the clutch bushing and consequently to the motor shaft via a particular auxiliary clutch known per se, thus making the clutch bushing and the motor shaft rotate. During this motion the axes of rotation of the planet wheels stand still, and only small masses rotate. The clutch is not engaged until the engine has come well into operation, i.e. the engine has reached a predetermined number of revolutions, whereby the starter is charged with energy. When the engine does not start at the first attempt, it is necessary to turn the carrier of the planet wheel by means of a crank-handle, cf. below. In this manner the ring secured to the drum rotates with a number of revolutions considerably lower than the number of revolutions of the planet wheel carrier, thus providing a suitable gear ratio when the spring is manually tensioned. Besides, the engine starter is very simple and consequently relatively inexpensive to manufacture.

According to the invention the planet wheels may be supported by a carrier mounted on the shaft section and rotatable relative thereto, and which furthermore may be turned by means of a crank-handle. As a further result a suitable gear ratio between the rotary motions of the drum and of the crank-handle is obtained, thus rendering it possible to tension the spring manually.

Moreover, according to the invention the ring connected to the drum may have approximately 7 per cent more teeth than the other ring. This provides a gear ratio of approximately 1:4 between the rotary motions of the drum and of the crank-handle, thus facilitating a manual tensioning of the spring.

Furthermore, according to the invention the clutch may comprise an outer and an inner clutch portion, and the outer clutch portion is part of the clutch bushing and the inner clutch portion is a cylinder permanently connected to the shaft section, the outer friction surface of said cylinder being resilient, and the inner surface of the outer clutch portion facing the cylinder comprises a plurality of recesses at regular intervals for receiving rollers, and each recess comprises a relatively large inclined surface extending so far towards the outer surface of the cylinder that the distance at the narrowest place is smaller than the diameter of the rollers. This provides an over-running clutch, in which the declutching may take place at a predetermined torque, since the rollers are wedged in between the outer surface of the cylinder and the above inclined surfaces during the transmission of a torque. As soon as the critical torque has been reached, the rollers are pressed past the narrowest place and slide into the next recess. During this motion the rollers break off the connection between the inner surface of the outer clutch portion and the outer surface of the cylinder in such manner that a declutching takes place.

Moreover, according to the invention the inclined surfaces may be resilient, thus providing particularly good possibilities for a roller to wedge on the narrowest place between an inclined surface and the outer surface of the cylinder.

Furthermore, according to the invention the clutch may comprise a roller cage provided with projections and rotatable relative to the outer clutch portion, each projection extending between two successive rollers. As a result a satisfactory clutching and declutching are obtained, since the above projections do not at all press on the rollers when the number of revolutions of the engine is low, for which reason said rollers only rotate in the above recesses without producing any permanent connection between the clutch portions. However, when the number of revolutions has exceeded a predetermined value, the roller cage and consequently the projections rotate in such manner that the rollers are pressed towards said narrowest places, thereby making the clutch more and more effective. At a predetermined torque the rollers slip past the narrow places and slide into the next recess, thus disengaging the clutch.

According to the invention the roller cage may be mounted with an easy fit within the outer clutch portion, and the roller cage comprises a ratchet gearing on its inside, which may cooperate with pawls mounted on fly-weights eccentrically journalled relative to the axis of the bushing. This implies in a particularly reliable manner that the roller cage when subjected to the centrifugal force can be pressed a suitable distance forward in its direction of rotation relative to the outer clutch portion.

Moreover, according to the invention the fly-weights may be connected by means of springs, thus rendering it possible to reposition the fly-weights and consequently the pawls to the starting position when the motor shaft and consequently the clutch bushing are stopped.

Finally, according to the invention the outer surface of the rings surrounding the planet wheels may be provided with a ratchet gearing, which may cooperate with a release member provided with a pawl and mounted on the housing. As a result the ring secured to the drum and consequently the drum itself may in a very easy manner be released when the engine is to be started by means of the engine starter according to the invention.

Figure 2:
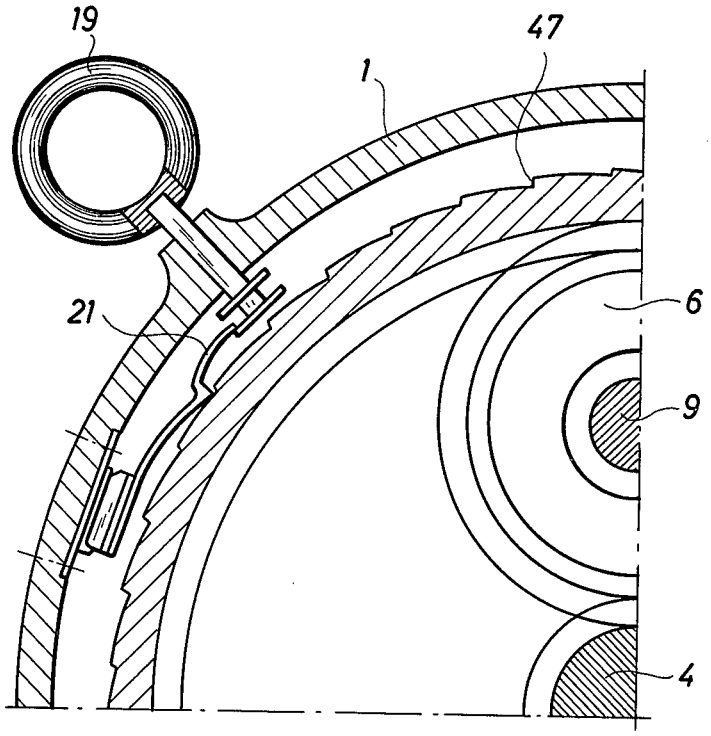
Figure 5:
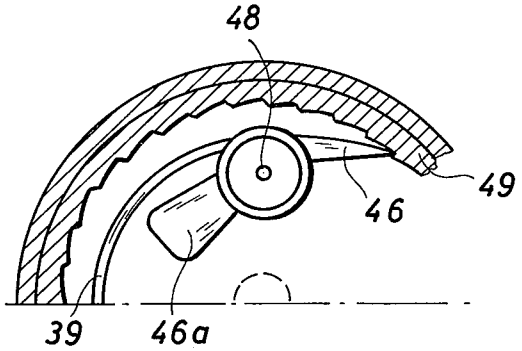
Figure 4:
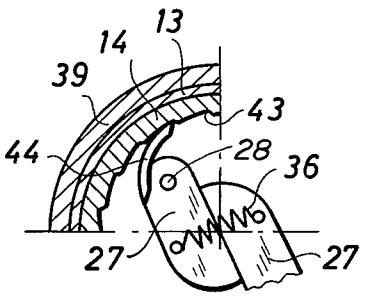
Figure 3:
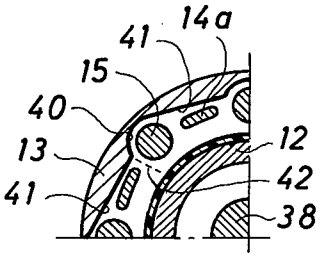

The invention will be described below with reference to the accompanying drawings, in which FIG. 1 is a fragmentary sectional view of an embodiment of the engine starter, the upper part of the Figure showing interior portions of the starter, FIG. 2 is a sectional view of the engine starter of FIG. 1 taken along the line II—II, FIG. 3 is a cross-sectional view of the clutch of the engine starter taken along the line III—III of FIG. 1, thus clearly illustrating the roller cage and the rollers, FIG. 4 is a sectional view of the clutch of FIG. 3 taken along the line IV—IV of FIG. 1, thus particularly illustrating the fly-weights eccentrically mounted, and FIG. 5 is a sectional view of the auxiliary clutch of the engine starter taken along the line V—V of FIG. 1.

The engine starter illustrated in FIG. 1 is coupled to a motor shaft 37, indicated by a dotted line, and secured to the side of an engine 52. The engine starter comprises a housing 1, in which a drum 3 is rotatably mounted. This drum is at its right end releasably connected to the motor shaft 37, since an auxiliary ring 49 internally toothed and permanently connected to the drum, and a pawl 46 are arranged between a clutch bushing 39 permanently connected to the motor shaft, and the drum. The pawl 46 can rotate about a pin 48 mounted in the clutch bushing 39. A spring 18 surrounds the drum 3, said spring at one end being secured to the outer side of the hub portion 3*a*, thus being indirectly connected to the motor shaft, and at the other end being secured on the inside of the housing 1.

The drum 3 may rotate about a separate shaft section 38, the left end of which is provided with a planetary gear. This planetary gear comprises planet wheels 6, of which only one is illustrated, and a sun gear 4 tooled on the shaft section 38. The planet wheel 6 comprises two toothings 6*a* and 6*b*, the toothing 6*a* cooperating with the toothing 4*a* of the sun gear 4. Two rings 7 and 8 internally toothed surround the planet wheels, the ring 7 being secured to the housing 1, and the ring 8 being secured to the drum 3. The internal toothing 7*a* of the ring 7 meshes with the toothing 6*a* of the planet wheel, and the internal toothing 8*a* of the other ring 8 secured to the drum meshes with the toothing 6*b* of the planet wheel.

A rotatable carrier 2 supports the planet wheels 6, the wheel and the carrier being provided with projections 9, of which only one is illustrated in FIG. 1. The wheels 6 can rotate on these projections 9. As it appears the carrier 2 is mounted on the outside of the shaft section 38, and on its left side it is provided with a projection 45, on which a crank-handle (not shown) may be mounted. The internal toothing 8*a* of the ring 8 is provided with 7 per cent more teeth than the toothing 7*a*, thus ensuring a suitable gear ratio between the rotary motions of the drum and of the crank-handle. Thus it is easy to tension the spring by hand in case of emergency. As illustrated in FIG. 1 the clutch bushing 39 extends to the left, and at its left end it is extended with an outer clutch portion 13, these two portions being permanently connected. An inner clutch portion 12 is mounted at the right end of the shaft section 38, said portion being a cylinder, the outer friction surface of which being resilient. The inner surface of the outer clutch portion is provided with a plurality of recesses 40 at regular intervals, cf. FIG. 3. Each recess comprises a relatively large inclined surface 41 extending so far towards the outer surface of the cylinder 12 that the distance between the outer and the inner portions at the narrowest place 42 is smaller than the diameter of the rollers 15. Usually the rollers project into the recesses 40. The rollers 15 are mounted in the slots between the axial projections 14*a* on a substantially cylindrical roller cage 14. This roller cage 14 is mounted within the outer clutch portion 13 in such manner that an easy fit is provided between the two portions. On its inside the roller cage comprises a ratchet gearing 43 which can cooperate with the pawls 44 and the fly-weights 27, said fly-weights being mounted at pivots 28 eccentrically relative to the common main axis of the shaft section 38 and the motor shaft 37. The fly-weights are mounted on the radial portion 13*a* of the outer clutch portion and interconnected by means of a spring 36. FIG. 4 clearly illustrates how the roller cage 14 is disposed relative to the clutch portion 13 during rotation, since each fly-weight 27 swings outwardly, and simultaneously the pawl 44 turns the cage 14 somewhat relative to the portion 13. This extra turn of the carrier does not take place until the number of revolutions of the motor shaft has become relatively high, and it implies that the rollers 15 are pressed towards the narrow places 42. While pressing towards these places the rollers can transmit a torque from the outer portion 13 to the inner portion 12 and consequently to the shaft section 38 so that the shaft section and consequently the pawl wheels and the drum rotate for a short period. The drum is loosely mounted on the shaft section 38. When the transmitted torque reaches a predetermined value the rollers tip over and slide into the next recess 40, whereby the clutch is disengaged in such manner that the outer portion 13 rotates independent of the inner portion 12. The spring 36 on the fly-weights 27 ensures that the cage does not press the rollers 15 further forwardly since the spring prevents the fly-weights from moving too far outwardly. The spring furthermore implies that the fly-weights are repositioned to the starting position when the engine is stopped.

As appears from FIG. 2 a ratchet gearing 47 is tooled on the outside of the rings 7 and 8. This ratchet gearing is intended for the cooperation with a pawl 21 secured to the inside of the housing 1. This pawl prevents the ring 8 and consequently the drum from rotating relative to the ring 7 when the spring 18 is tensioned. The pawl 21 may be removed from the toothing by means of a release member 19 mounted on the wall of the housing 1.

The engine starter operates as follows. At first the spring 18 is tensioned and the pawl 21 secures the rings 7 and 8 relative to each other. Subsequently, the engine is started by drawing in the release member 19 thus implying that the drum 3 starts to rotate. This rotary motion is transmitted to the clutch bushing 39 via the pawl 46. When the speed of revolution of the motor shaft has reached a predetermined value, the counterweight **46*a* of the pawl removes the pawl 46 from the internal toothing of the auxiliary ring 49 in such manner that the connection between the drum and the motor shaft is cut. Now the engine has come into operation and the speed of revolution increases. Since the clutch bushing 39 is connected to the outer clutch portion 13, and the clutch portion 39 is connected to the shaft 37, the portions 13 and 39 rotate quickly. When the speed of revolution has reached a predetermined value, the fly-weights 27 swing outwardly, which implies that the pawl 44 turns the roller 15 cage 14 further relative to the outer clutch portion 13, as explained above. This implies that the rollers are gradually pressed towards the narrowest places 42, cf. FIG. 3. During this motion a torque is transmitted from the outer clutch portion 13 to the inner clutch portion 12 thus implying that the drum 3, as previously mentioned, rotates and consequently the spring 18 is tensioned about the drum. In consequence of the planetary gear, the drum is turned in a direction opposite its direction during the first stage of the engine starting operation. When the rollers 15 pass the narrowest places 42, the transmitted torque is at a maximum corresponding to the maximum load withstanded by the spring 18. As soon as the rollers 15 have passed the narrowest places 42 they slide into the next recess; in this moment the clutch is disengaged so that the outer clutch portion 13 from now on rotates independent of the inner clutch portion 12. The pawl 21 prevents the rings 7 and 8 from rotating relative to each other, cf. FIG. 2, since the rings are provided with a toothing 47 with which the pawl meshes. In this manner the pawl prevents the drum 3 from rotating. When the engine is stopped and later on is to be restarted, the above operation is repeated by releasing again the pawl 21 by means of the release member 19 so that the drum 3 can rotate freely and consequently transmit its motion to the clutch bushing 39**.

Should the engine starter not start as expected, it is necessary to tension the spring of the starter by hand, i.e. by mounting a crank-handle on a projection 45 of the planet wheel carrier 2.

The above engine starter has a very simple construction, and is very suitable for mass production since most of the portions are suitable for injection moulding in plastics.

We claim:

1. A starter for a motor having a motor shaft, said starter comprising a stationary housing; a rotatable drum adapted to be releasably connected to the motor shaft; a spring having a first end secured to said drum and a second end secured to the inside of said housing; a planetary gear assembly including planet wheels, two internally-toothed planet rings surrounding said planet wheels, and a sun gear having a shaft section, each of said planet wheels having two toothings meshing respectively with said two planet rings, one of said planet rings connected to said housing and the other of said planet rings secured to said drum, said planetary gear assembly driving said drum; an axially extending clutch bushing adapted for permanent connection to one end of the motor shaft; and a clutch assembly including a plurality of rollers, an outer clutch portion forming a part of said clutch bushing, and a cylndrical inner clutch portion permanently connected to said sun gear shaft section, said inner clutch portion having a resilient outer friction surface, said outer clutch portion having an inner surface facing said inner clutch portion with a plurality of recesses at regular intervals for receiving said rollers, each recess comprising a relatively large inclined surface extending towards the outer cylindrical surface of said inner clutch portion so far that the distance at the narrowest place therebetween is smaller than the diameter of said rollers; said clutch assembly engaging when said clutch bushing rotates at a speed exceeding a predetermined value and disengaging when the torque of said clutch assembly exceeds a predetermined value.

2. A starter as claimed in claim 1 further comprising a release member provided with a pawl and mounted on the housing, and in which the outer surface of said planet rings is provided with ratchet gearing cooperating with said release member.

3. A starter as claimed in claim 1 further comprising a carrier member mounted on said shaft section and supporting said planet wheels, said carrier member rotatable with respect to said shaft section and adapted to be turned by means of a crank-handle.

4. A starter as claimed in claim 1 in which the planet ring secured to said drum has approximately seven per cent more teeth than does the planet ring connected to said housing.

5. A starter as claimed in claim 1 in which the inclined surfaces are resilient.

6. A starter as claimed in claim 1 in which said clutch assembly includes a roller cage provided with projections and rotatable relative to said outer clutch portion, each projection extending between two successive rollers.

7. A starter as claimed in claim 6 in which said roller cage is mounted with an easy fit within said outer clutch portion and has ratchet gearing on the inside thereof; said clutch assembly further comprising fly-weights eccentrically journalled relative to the axis of said bushing and having pawls mounted thereon to cooperate with the ratchet gearing.

8. A starter as claimed in claim 7 in which said clutch assembly further comprises spring means connecting said fly-weights.

* * * * *